United States Patent [19]

Given

[11] Patent Number: 4,660,794

[45] Date of Patent: Apr. 28, 1987

[54] LADDER TRAY

[76] Inventor: William B. Given, R.F.D. #1, Box 417, Kenduskeag, Me. 04450

[21] Appl. No.: 850,968

[22] Filed: Apr. 11, 1986

[51] Int. Cl.[4] ..... E06C 7/14

[52] U.S. Cl. ..... 248/238; 182/120; 182/129

[58] Field of Search ..... 248/238, 210; 182/129, 182/120, 214, 228

[56] References Cited

U.S. PATENT DOCUMENTS

| | | | |
|---|---|---|---|
| 3,283,402 | 11/1966 | Larson | 182/228 |
| 3,495,683 | 2/1970 | Broden | 248/210 |
| 3,985,203 | 10/1976 | Erlenbach | 248/210 |
| 3,987,993 | 10/1976 | Hopkins | 248/210 |
| 4,099,693 | 7/1978 | Blann | 248/210 |
| 4,489,911 | 12/1984 | Riley | 248/238 |
| 4,523,733 | 6/1985 | Lunden | 248/210 |

*Primary Examiner*—Reinaldo P. Machado
*Attorney, Agent, or Firm*—David F. Gould

[57] ABSTRACT

A work tray for mounting on hollow rung ladders. The tray has a single shaft which goes through one rung of the ladder. Lock means are provided to keep the tray from rotating or from pulling out of the rung. Angular adjustment means are provided so that the tray may be kept level when the ladder is used at different angles.

1 Claim, 15 Drawing Figures

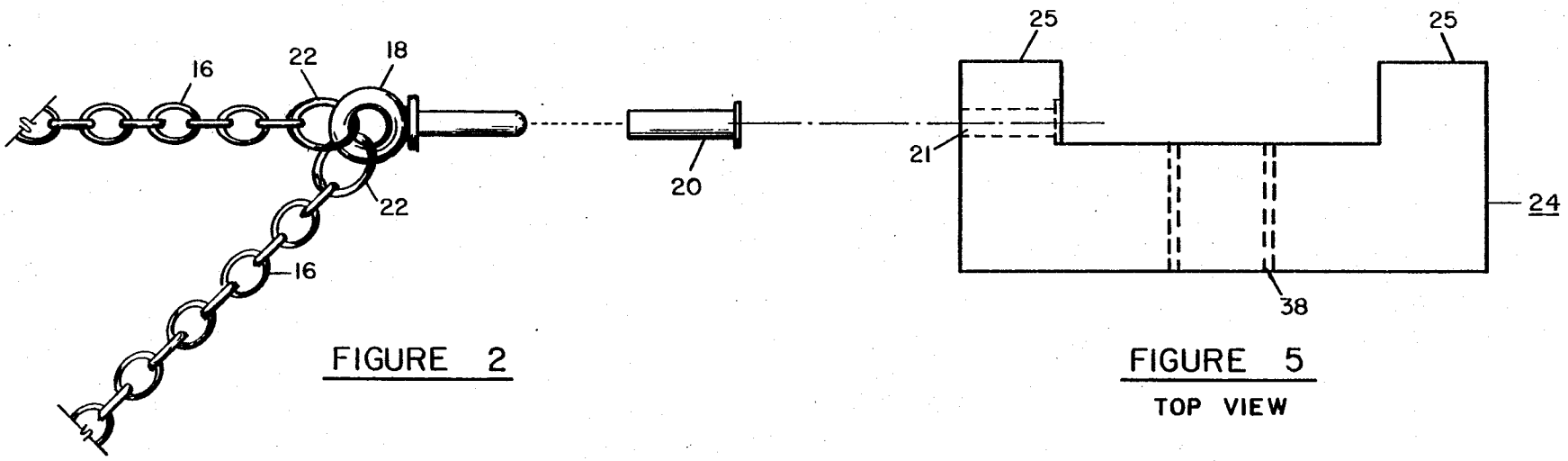
FIGURE 5
TOP VIEW
FIGURE 2
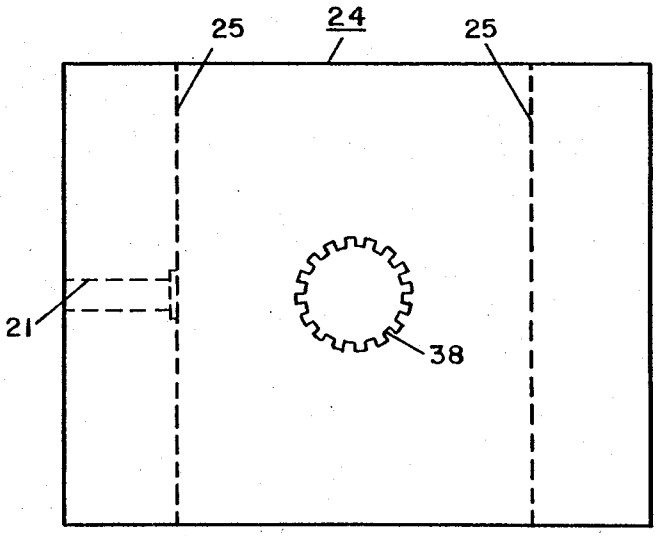
FIGURE 6
FRONT VIEW
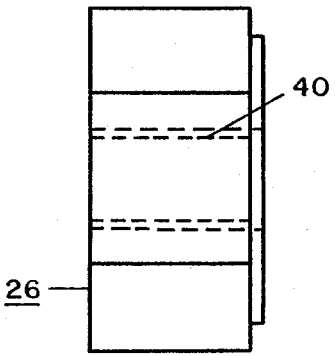
FIGURE 4
SIDE VIEW
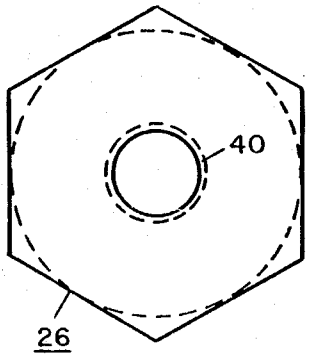
FIGURE 3
FRONT VIEW

FRONT VIEW

SIDE VIEW

LADDER TRAY

BACKGROUND

1. Field of the Invention

My invention relates to the field of ladder work trays and more particularly relates to a ladder work tray designed for use with hollow rung ladders. The principle of the invention is a support shaft attached to the tray which passes through a hollow rung of the ladder. The shaft is kept from rotating by a block on the end of the shaft which engages one of the ladder side rails. Provision is made to hold the tray nearly level regardless of the angle of the ladder. The tray is designed to hold tools and painting equipment for workers on ladders.

2. The Prior Art

The prior art includes U.S. Pat. No. 3,822,846, to Jesionowski. This invention places a stud inside of the hollow ladder rung and uses a cam to lock the device in position. A similar invention is U.S. Pat. No. 4,318,523 to Weatherly. This invention uses two rungs for mounting the tray. Another invention, U.S. Pat. No. 4,445,659 to LaChance also requires the use of two hollow ladder rungs. Still another invention, U.S. Pat. No. 4,489,911 to Riley also uses two rungs of the ladder to hold the tray in place. These inventions have drawbacks that include overly complex manufacture, high cost and difficulty of erecting.

SUMMARY OF THE INVENTION

My invention is a solution to the problem of how to provide a ladder tray that is simple and inexpensive in construction. My invention also provides a ladder tray that may be mounted using one rung of the ladder and that may be adjusted and held to a nearly level position regardless of the angle of the ladder. I provide a tray on one end of a longitudinally fluted shaft. The shaft is small enough in diameter to produce a sliding fit when passed through the hole in one of the rungs of a conventional metal ladder. On the other end of the shaft I place a stabilizer block which engages the rail of the ladder on that side. Locking means are provided to keep the block engaged with the ladder rail and the shaft from rotating and thus to hold the tray rigid. In addition, provision is made to lock the tray in the desired angle relative to the ladder rails so as to be in a nearly horizontal position to keep tools and paints from sliding off the tray.

DESCRIPTION OF DRAWINGS

FIG. 2 is a side view of safety chain attachments.

FIG. 3 is a front view of the cinch nut of FIG. 1.

FIG. 4 is a side view of the cinch nut of FIG. 1.

FIG. 5 is a top view of the stabilizer block of FIG. 1.

FIG. 6 is a front view of the stabilizer block of FIG. 1.

DESCRIPTION OF PREFERRED EMBODIMENT

Figure 7:
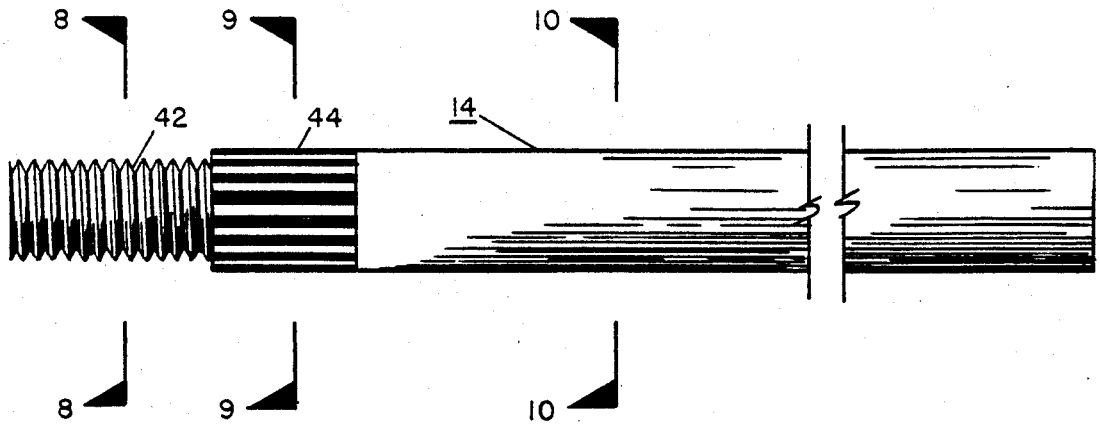
FIG. 7 is a side view of the shaft of FIG. 1.
Figure 8:
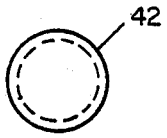
FIG. 8 is an end view of the threads of FIG. 7 taken along the plane 8—8.
Figure 11:
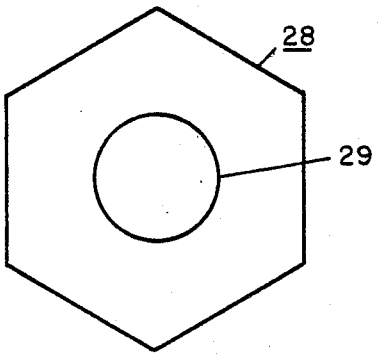
FIG. 11 is a front view of the spacer of FIG. 1.
Figure 12:
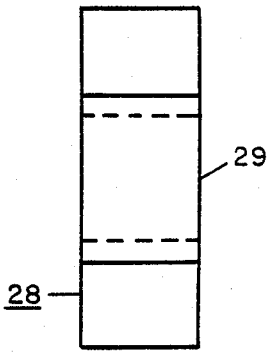
FIG. 12 is a side view of the spacer of FIG. 1.
Figure 13:
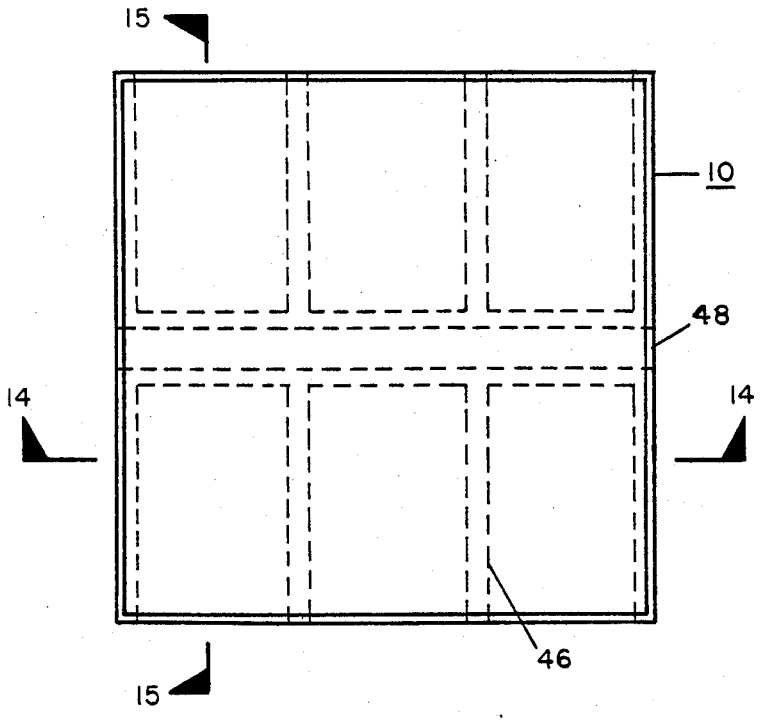
FIG. 13 is a top plan view of the tray of FIG. 1.
Figure 14:
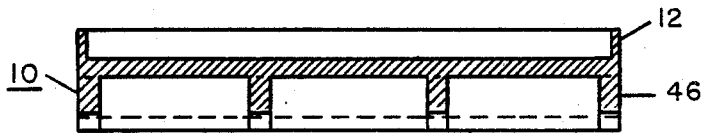
FIG. 14 is a sectional view of the tray of FIG. 1 taken along the plane 14—14.
Figure 15:
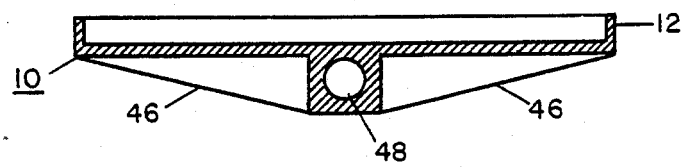
FIG. 15 is a sectional view of the tray of FIG. 1 taken along the plane 15—15.

As shown in in the drawings, where like numerals refer to like parts throughout, I provide a tray 10 having a low raised edge 12 around the top surface. The tray 10 is attached to a shaft 14 that has a male longitudinally fluted portion 44 and a threaded end portion 42 as best seen in FIG. 7. On the other end of the shaft from the tray 10, I provide a stabilizer block 24 which has a centrally located female fluted hole 38. The block 24 is provided with shoulders 25. The block 24 is shaped to engaged the side rail 36 of a conventional commercially available aluminum, wood or fiber glass ladder 32 of the variety having a plurality of hollow rungs such as hollow rung 34. The stabilizer block 24 prevents rotation of the shaft 14 and the attached tray 10. The nut 26 is a non-essential safety feature which prevents separation of the block 24 and the tray 10. As shown in FIGS. 2, and 5, chains 16 may be fastened to the block 24 by means of a rivet eye bolt 18 and a female rivet 20. A hole 21 is provided in one of the shoulders 25 of block 24 for this purpose. Chain rings 22 may be used to attach the chains 16 to the rivet eye bolt 18. In the center of the block 24, as best seen in FIG. 6, is provided a female fluted hole 38. The fluting 38 is sized to slidably engage the male fluting 44 of the shaft 14 as seen in FIG. 7. The cinch nut 26, as seen in FIGS. 3 and 4, is provided to engage the threaded end 42 of the shaft 14. A spacer 28, as best seen in FIGS. 11 and 12, is provided to fit between the cinch nut 26 and the block 24. The spacer 28 is provided with a central hole 29. The function of the spacer 28 will be detailed hereinafter in reference to the operation of the invention. The construction of the tray 10 may be best understood with reference FIGS. 13 thru 15. The tray 10 may be made of metal, plastic, nylon, wood or other materials and may be provided with stiffening members 46 on the under side. A central hole 48 is provided in the tray 10 to receive the shaft 14. The invention is made so that the shaft 14 is rigidly attached to the tray 10. The shaft 14 is not allowed to use to rotate in the hole 48 of the tray 10. However, the shaft 14 and the tray 10 may be demountable, thus allowing for easy transport and storage.

OPERATION

Figure 1:
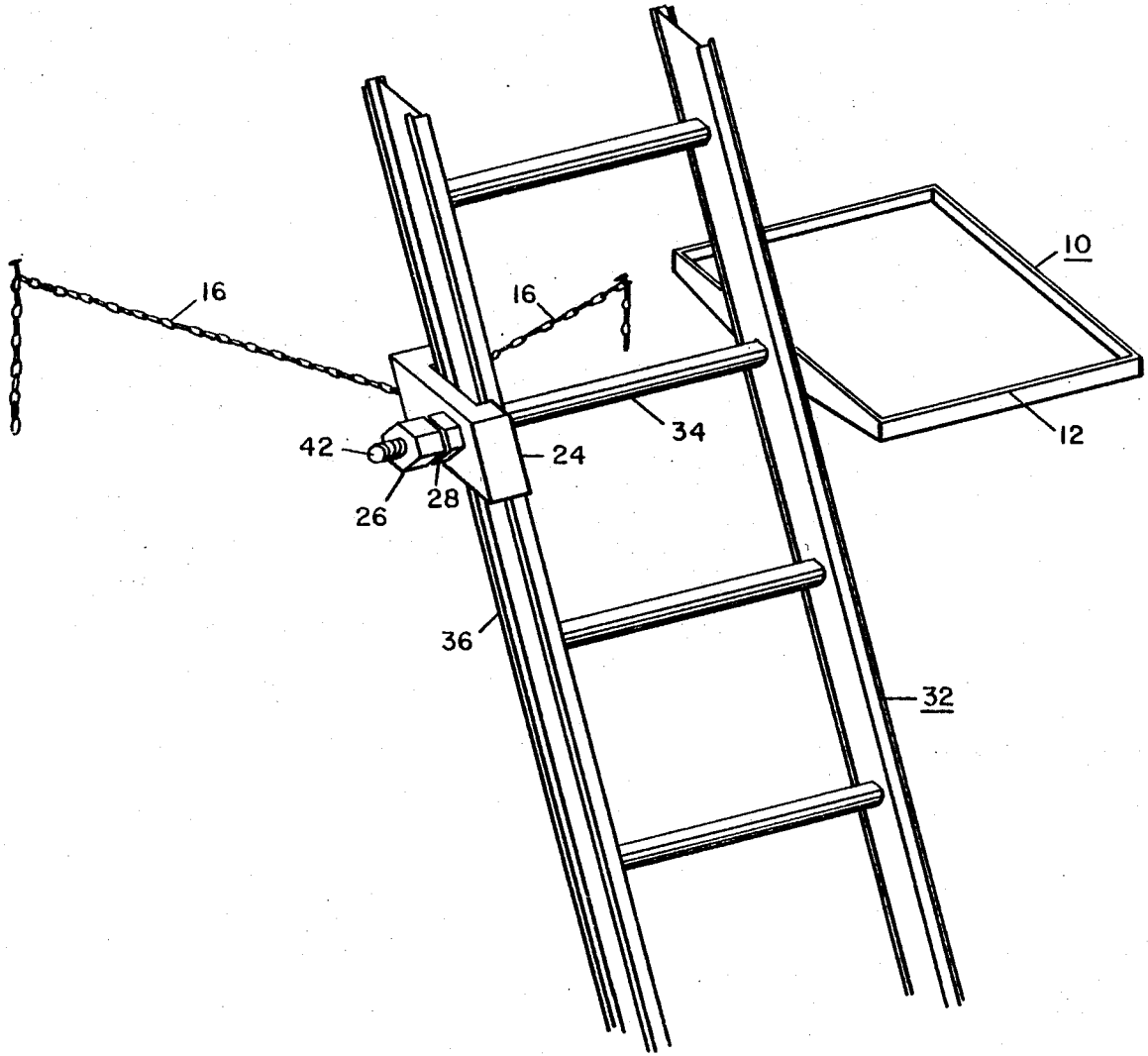
FIG. 1 is a perspective view of the invention on a ladder.
Figure 9:
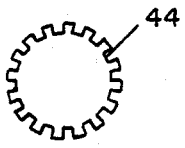
FIG. 9 is a section of the flutes of FIG. 7 taken along the plane 9—9.
Figure 10:
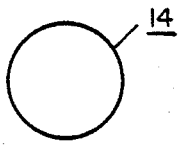
FIG. 10 is a section of the shaft of FIG. 7 taken along the plane 10—10.

In operation, the shaft 14 with its attached tray 10 is pushed through the center of the desired rung 34 of the ladder 32, as best illustrated in FIG. 1. The stabilizer block 24 is then placed over the shaft 14 so that the shoulders 25 of the block 24 engage the left side rail 36 of the ladder 32. The block 24 is followed by spacer 28 and finally the cinch nut 26 which is placed over the threaded end 42 of the shaft 14. The female flutes 38 of the block 24 engage the male flutes 44 of the shaft 14. The cinch nut 26 is then tightened to hold the desired angular position of the tray 10. The tray 10 is thus prevented from rotating and stays in the level position in which it was first inserted through the rung 34. The safety chains 16 may be then attached to the side of the building or other object to which the ladder 32 is applied. The flute arrangement illustrated in FIGS. 6, 7 and 9 allows the tray 10 to be adjusted to a nearly level position no matter what the angle of the ladder rail 36.

Once the cinch nut 26 is tightened flutes 38 and 44 prevent any rotation of the tray 10 from the selected flute alignment. The present invention can be installed at any height by one person and is easily and safely moved. The tray 10 can support sufficient weight of the usual tools of a handyman. The raised portion 12 around the edge of the tray 10 keeps any materials from rolling off the tray 10 due to the normal minor motions of the ladder. The block 24 is sized to fit most available ladders and the spacer block 28 allows adjustment when the invention is applied to the upper half of an extension ladder in which the width of the side rail of the extension portion of the ladder is of slightly less than the side rail of the base portion of the extension ladder. Although illustrated with the tray on the right of the ladder, the invention can be reversed to put the tray on the left of the ladder for a left-handed user.

The foregoing is considered as illustrative only of the principles of the invention. Furthermore, since numerous modifications and changes such as the number of flutes will readily occur to those skilled in the art, it is not desired to limit the invention to the exact construction and operation shown and described, and accordingly all suitable modifications and equivalents may be resorted to falling within the scope of the invention as claimed.

I claim as my invention:

1. A work tray for hollow rung ladders comprising:

a. shaft having a longitudinally fluted portion, b. a tray attached to the shaft, c. a stabilizer block shaped to engage one of the side rails of a ladder, d. a fluted hole in the stabilizer block to slidably engage the fluted portion of the shaft to prevent rotation of the shaft and attached tray.

* * * * *